US010589312B2

(12) United States Patent
Grontved

(10) Patent No.: US 10,589,312 B2
(45) Date of Patent: Mar. 17, 2020

(54) HOUSING AND DISPENSER

(71) Applicant: Sulzer Mixpac AG, Haag (CH)

(72) Inventor: Martin Grontved, Haarlev (DK)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 16/301,862

(22) PCT Filed: Apr. 27, 2017

(86) PCT No.: PCT/EP2017/060089
§ 371 (c)(1),
(2) Date: Nov. 15, 2018

(87) PCT Pub. No.: WO2017/207188
PCT Pub. Date: Dec. 7, 2017

(65) Prior Publication Data

US 2019/0151887 A1 May 23, 2019

(30) Foreign Application Priority Data

May 31, 2016 (EP) ..... 16172309

(51) Int. Cl.
*B05C 17/005* (2006.01)
*B05C 17/01* (2006.01)

(52) U.S. Cl.
CPC ..... *B05C 17/00553* (2013.01); *B05C 17/01* (2013.01)

(58) Field of Classification Search
CPC ..... B05C 17/00553; B05C 17/01; B05C 17/00596; B05C 17/0103; B05C 17/0116; B05C 17/015; B05C 17/0136
(Continued)

(56) References Cited

U.S. PATENT DOCUMENTS 3,311,265 A 3/1967 Creighton, Jr. et al.
4,264,021 A 4/1981 Davis, Jr.
(Continued)

FOREIGN PATENT DOCUMENTS

EP 0541972 A1 5/1993
EP 0721805 A2 7/1996
(Continued)

OTHER PUBLICATIONS

International Search Report dated Aug. 10, 2017 in corresponding International Application No. PCT/EP2017/060089, filed Apr. 27, 2017.
(Continued)

*Primary Examiner* — Donnell A Long

(74) *Attorney, Agent, or Firm* — Global IP Counselors, LLP

(57) ABSTRACT

A housing for a dispenser includes two non-metal half shells forming respective sides of at least a front part of the housing, with the front part of the housing including a cartridge receptacle, and with the two non-metal half shells being connected to one another. The housing further includes a reinforcing plate forming at least part of a front end of the cartridge receptacle, with the reinforcing plate being received between the two non-metal half shells and including a retainer configured to connect the two non-metal half shells at the front end of the cartridge receptacle.

19 Claims, 5 Drawing Sheets

(58) Field of Classification Search
USPC ..... 222/325, 386, 390, 391
See application file for complete search history.

(56) References Cited

U.S. PATENT DOCUMENTS

| | | | | |
|---|---|---|---|---|
| 5,263,614 | A | 11/1993 | Jacobsen et al. | |
| 5,332,122 | A | 7/1994 | Herold et al. | |
| 5,875,928 | A | 3/1999 | Muller et al. | |
| 5,924,600 | A | 7/1999 | Keller | |
| 6,290,101 | B1 | 9/2001 | Chang | |
| 6,454,138 | B1 | 9/2002 | Greenhill et al. | |
| 7,014,070 | B1 | 3/2006 | Stefely et al. | |
| 8,991,651 | B2 * | 3/2015 | Yeh | B65D 83/0005 222/137 |
| 10,166,570 | B1 * | 1/2019 | Lee | B05C 17/015 |
| 2002/0145014 | A1 | 10/2002 | Harris | |
| 2002/0145015 | A1 | 10/2002 | Nelson | |
| 2005/0006413 | A1 * | 1/2005 | Miyata | B05C 17/00513 222/327 |
| 2005/0019172 | A1 | 1/2005 | Chang | |
| 2005/0023301 | A1 * | 2/2005 | Rumrill | B05C 17/01 222/391 |
| 2006/0138166 | A1 | 6/2006 | Nehren et al. | |
| 2007/0181607 | A1 | 8/2007 | Calvo et al. | |
| 2008/0144426 | A1 * | 6/2008 | Janssen | B01F 7/00216 366/130 |
| 2009/0127278 | A1 * | 5/2009 | Hefele | B05C 17/01 221/248 |
| 2012/0160876 | A1 | 6/2012 | Brummitt | |
| 2013/0186912 | A1 | 7/2013 | Yeh | |
| 2016/0045928 | A1 * | 2/2016 | Frey | B05C 17/00516 222/94 |

FOREIGN PATENT DOCUMENTS

| | | | |
|---|---|---|---|
| EP | 1609735 | A1 | 12/2005 |
| JP | 2002331262 | A | 11/2002 |
| WO | 2007098624 | A1 | 9/2007 |

OTHER PUBLICATIONS

Extended European Search Report dated Nov. 22, 2016 in corresponding European Patent Application No. 16172309.3, filed May 31, 2016.

* cited by examiner

HOUSING AND DISPENSER

CROSS-REFERENCE TO RELATED APPLICATION

This application is a U.S. National Stage application of International Application No. PCT/EP2017/060089, filed Apr. 27, 2017, which claims priority to European Patent Application No. 16172309.3, filed May 31, 2016, the contents of each of which are hereby incorporated herein by reference.

BACKGROUND

Field of the Invention

The present invention relates to a housing for a dispenser, in particular for a one or two-component dispenser, preferably a hand held dispenser, and to a dispenser, in particular to a one or two-component, preferably hand held dispenser having such a housing.

Background Information

Two component dispensers are used to dispense materials from two-component cartridges for a plethora of applications ranging from the dispensing of substances used in the dental fields, e.g. for forming dental impressions, to the field of construction, e.g. for forming seals at windows or settings chemical anchors, and generally to the application of adhesives, e.g. for gluing wind screens (windshields) into car bodies.

Some of these dispensers comprise plastic housings for this purpose. In these the housing typically comprises two main parts extending on both sides from a handle, located at a rear end of the dispenser, to the very front of the dispenser. These two parts need to be connected one to another except for the region at the front where a cartridge outlet optionally connected to a mixing nozzle has to be able to be passed through an opening.

SUMMARY

In this region of the opening, the cartridge holder is prone to deformation. This deformation is brought about through the application of pressure when the dispenser is in a dispensing mode of operation. During the dispensing mode of operation push rods present in the dispenser exert a force on pistons present in the cartridge. This force is transmitted towards the front end of the cartridge where it is applied to the housing in the region of the housing having the opening. This can even lead to the opening being widened and pushed apart by the pressure, i.e. transforming a "U" shaped opening to a "V"-shaped opening.

A second known way of building more stable cartridge holders is to use metal. Such holders are commonly made from a single piece which helps with the mechanical stability, but they need to be affixed to the rest of the body (main body and handle) often using complex assemblies. Moreover, such dispensers are usually heavier and more expensive than their plastic counterparts.

Furthermore, dispensers are known for sausage bag type applications. In this case they usually comprise a pipe, e.g. a metal pipe, into which the sausage bag is inserted and which has a front plate that comprises a device or means to connect the sausage bag to a mixing nozzle. On replacing the sausage bag, the front plate typically also has to be replaced as the device or means used to connect the sausage bag to a mixing nozzle get contaminated with the components to be dispensed which are initially present in the bag and which are frequently adhesives, rendering the front plate unusable.

For this reason it is an object of the invention to produce a more cost effective dispenser that has an increased protection against deformation and has a reduced weight in comparison to those known from the prior art.

This object is satisfied by a housing having the features described herein.

Such a housing for a dispenser, in particular a two-component hand-held dispenser, comprises two non-metal half shells forming respective sides of at least a front part of the housing, with the front part of the housing comprising a cartridge receptacle, and with the two non-metal half shells being connected to one another; the housing further comprising a reinforcing plate forming at least part of a front end of the cartridge receptacle, with the reinforcing plate being received between the two non-metal half shells and comprising a retainer configured to connect the two non-metal half shells at the front end of the cartridge receptacle.

In this way e.g. a plastic dispenser housing is made available that has a reinforced front, e.g. comprising metal, to cope with forces arising during a dispensing action.

Advantageously the reinforced plate has retainer that projects in a dispensing direction of the dispenser, so that they engage the two non-metal half shells in the direction of the application of forces. In this way the retainer can be configured to aid in the reinforcement of the front end of the dispenser such that the influence of the forces thereon is reduced.

In this connection it should be noted that the reinforcing plate can be configured such that the retainer is only formed on one side face of the reinforcing plate, i.e. such that the other side of the reinforcing plate is at least substantially flat. Alternatively the other side of the reinforcing plate that does not include the retainer can be designed such that it has a shape that is complementary to a certain type of cartridge. This shape can be selected to aid the introduction of the cartridge into the dispenser and/or to compensate any forces that may be transmitted via the cartridge onto the front end.

It should also be noted that the side of the reinforced plate having the retainer may comprise at least one projection and/or at least one recess forming the retainer. Such projections and recesses form simple and effective retainers and can be used to prevent a spreading apart of the two sides respectively formed by the two non-metal half shells forming at least a part of the respective side of the housing.

Preferably each half shell forms a complete side of the dispenser. Optionally parts of a handle of the dispenser can be formed in at least one of the half shells forming a complete side of the dispenser. Forming the half shells as complete sides means that the components of e.g. a hand held dispenser, such as, for example, a trigger lever, an actuation mechanism, push rods etc. can be mounted at suitable pivot points or guide points within the respective half shell aiding an assembly of the dispenser, both on first assembly and also in the event that parts of the dispenser need to be repaired, i.e. on servicing a dispenser.

Advantageously the two non-metal half shells are connected one to another at several points where the two non-metal half shells contact one another. One of these points of connection is advantageously formed by the reinforcing plate by the retainer.

It should further be noted that the use of predominantly non-metal half shells also reduces the weight of the dispenser, thereby making the dispenser easier to handle.

It is preferred if the reinforcing plate comprises an opening extending from a rear side to a front side of the reinforcing plate. Preferably, the opening is additionally open at a narrow side of the reinforcing plate and thus has an open cross-section. In particular the opening may be formed as a U-shaped slot, a V-shaped slot or a rectangular-shaped slot. In other words, the opening may be a through-hole which is additionally open in a lateral direction.

Forming the opening in the reinforcing plate in addition to the sides of the housing means that the reinforcing plate can form a reinforcement at the front end of the housing at the position of the opening present in the housing, with the reinforcement being present where the forces are applied. In this way the reinforcing plate can also be configured to dampen any effects brought about by the forces transmitted via the cartridge at that point of the housing that is affected most by these forces.

It should be noted in this connection that the opening can be open towards a top end of the dispenser, such that the plate can be considered to have a recess at the position of the opening. In other words the reinforcing plate has an opening that is open e.g. in a direction perpendicular to the dispensing direction.

In yet other words the opening is preferably open to one side of the housing, namely the side of the housing where the cartridge receptacle is open for a reception of a cartridge. In this way the slot forms an opening to receive a cartridge front end and/or a mixer that can be connected to the cartridge. Forming the opening completely in the reinforcing plate means that the durability of the front end of the dispenser is enhanced.

It is preferred if the two non-metal half shells respectively comprise a holder at the front end of the cartridge receptacle that cooperate with the retainer formed in or at the reinforcing plate and with the holder being formed at a respective inner surface of the two non-metal half shells at a front end thereof.

Thus, the holder preferably projects into the reinforcing plate, in some instances the holder projects e.g. into a direction opposite to a dispensing direction of the dispenser. Due to the interplay present between the retainer and the holder, the two non-metal half shells can be connected at the front end via the reinforcing plate and indeed in such a manner that prevents the two non-metal half shells from being pressed apart on an application of force via the cartridge.

In this connection the inner surface of the front end of the two non-metal half shells can have projections and recesses forming the holder that interact with the retainer.

It should be noted in this connection that the retainer and the holder respectively form adjacent surfaces that cooperate with one another to prevent a movement of the two non-metal half shells with respect to the reinforcing plate in a direction at least substantially perpendicular to the dispensing direction and preferably at least substantially perpendicular to a direction in which a cartridge is inserted into the cartridge receptacle. In this way a spreading apart of the two non-metal half shells in the region of the opening in two opposed separating directions can be avoided. Each separating direction is thereby defined as direction running substantially perpendicular to the dispensing direction and substantially perpendicular to the insertion direction of the cartridge into the cartridge receptacle. In other words, the retainer and the holder comprise surfaces which are pressed against each other in one of the separating directions during a dispensing action. Preferably these surfaces may be running substantially parallel to the separating directions. The surfaces may also be arranged in any angle with respect to the separating directions as long as they do not run parallel to the separating directions.

Advantageously the holder engages undercuts present in the retainer. Such undercuts are advantageous in connecting the two non-metal half shells to the reinforcing plate, as they enable an anchorage thereof at the reinforcing plate. The undercuts can e.g. comprise recesses, grooves and/or protrusions being formed in or at a surface of the retainer which cooperate with corresponding counterparts being formed in or at the holder.

Moreover, the use of undercuts enhances the stability of connection between different components as the surface area present between the two parts connected to one another is increased.

Preferably the retainer comprises retaining ribs that cooperate with holding ribs or holding clamps formed in each of the two non-metal half shells.

The use of ribs is beneficial as these, on the one hand, strengthen all parts involved e.g. the reinforcing plate and the front end of two non-metal half shells and permit a reduction in thickness of the material used. This leads to a cost and weight saving if e.g. a metal plate is used, as less metal material is consumed.

In this connection it should be noted that the outer shape of the ribs can have a specific design, for example, a non-constant outer width. In this connection the ribs may have an outer design in which the two side surfaces of the ribs taper towards one another from one end of the rib to the other. Likewise ribs having at least one substantially curved side surface, e.g. concavely or convexly curved side surface, in a front view thereof, could also be provided.

Forming the retaining ribs, e.g. with a tapering design, i.e. a conical design in a front view thereof, and consequently forming complementary shapes in the front end of the two non-metal half shells increases the stability of the front end and further prevents the two non-metal half shells from being pressed apart on an application of pressure at the front end in a direction perpendicular to the dispensing direction. This is because the varying sizes of the parts complementary to one another block the other part from moving in the direction perpendicular to the dispensing direction. Advantageously such specifically designed retaining ribs also increase the stability of connection of the reinforcing plate to the two non-metal half shells on an assembly of the housing.

Advantageously the retaining ribs form an at least substantially V-shaped structure or W-shape structure in the side of the reinforcing plate having the retainer, in a front view thereof. That means that at least some of the ribs do not run parallel to each other but obliquely. Such designs likewise increase the stability of the front end of a housing and further prevent the two non-metal half shells from being pressed apart on an application of pressure at the front end.

In this connection it should be noted that a height of the ribs may be constant or also vary over the length of the ribs. Thereby the height of a rib is defined by its extent from a base part of the rib forming the connection to the retainer to the opposite free end surface of the rib.

Preferably the reinforcing plate comprises at least one groove extending in a peripheral region and each non-metal half shell comprises at least one projection engaging into the at least one groove. A groove can advantageously aid in the attachment of the two non-metal half shells to the reinforcing plate. Moreover, such a groove interacting with projections of the two non-metal half shells also forms a barrier within the reinforcing plate that aids in preventing the two non-metal half shells from being pushed apart on an application of force. It is also possible that the at least one groove is formed in the non-metal half shells and that the at least one projection is formed in the reinforcing plate. Further, the non-metal half shells can comprise both, grooves and projections which interact with corresponding projections and grooves provided at/in the reinforcing plate.

In this connection it is advantageous if the at least one groove comprises at least one recess and if one or each of the non-metal half shells comprises at least one further projection engaging into the at least one recess. Preferably the at least one groove comprises a plurality of recesses, with the walls present between the recesses being formed by the ribs. Likewise each non-metal half shell hence comprises a plurality of projections which interact with the plurality of recesses. In this way the retainer form the barrier that prevents the two half shells from being moved apart in a direction perpendicular to the dispensing direction in a dispensing mode of operation of the dispenser comprising such a housing.

It is preferred if the retainer comprises a peripherally extending outer rim and if each non-metal half shell comprises at least one groove, wherein the outer rim at least partially engages into the respective at least one groove formed in each non-metal half shell. The use of a rim as a retainer in a reinforcing plate aids in the connection between the two non-metal half shells and the reinforcing plate.

In this connection the rim does not have to have a constant outer width, but the width can vary along the length of the rim. E.g. the sides of the rim can have a conical design. Such a specifically designed rim improves the connection between the two non-metal half shells and the reinforcing plate.

It should further be noted that the rim can comprise an undercut to further enhance the connection of the reinforcing plate to each of the two non-metal half shells and thereby the connection between the two non-metal half shells. The undercut can e.g. comprise recesses, grooves and/or protrusions being formed in or at the rim which cooperate with corresponding counterparts being formed in or at tow non-metal half shells.

Advantageously the two non-metal half shells are connected to one another either in a releasable or a non-releasable manner. Providing a releasable connection means that the dispenser can be serviced if components thereof require servicing.

Alternatively the dispenser can be designed such that the complete housing needs replacing once a dispenser needs to be serviced. In this way a stability of the housing can be ensured throughout the lifetime of the dispenser.

It is advantageous if the reinforcing plate forms at least 70%, preferably forms approximately 90%, of a surface area of an inner front end face of the cartridge receptacle. Forming the inner front face such that it is formed mostly by the reinforcing plate means that the point of contact at the front end of the housing between the cartridge installed in the cartridge receptacle and the housing is formed by the reinforcing plate. In this way any forces transmitted by the cartridge in the direction of the front end can be compensated by the reinforcing plate at the point of contact.

In this connection it should be noted that it is preferable if the two non-metal half shells further comprise at least one snap-in member, with the at least one snap-in member being configured to engage the reinforcing plate. In this way the two non-metal half shells can engage the reinforcing plate to e.g. hold and retain this in its position by at least one snap-in member. Such an engagement ensures the correct positioning of the reinforcing plate e.g. on a removal and reinstallation of a cartridge.

Forming snap-in members at the front end also means that the connection between the two non-metal half shells in the region of the reinforcing plate can be without screws or the like.

Advantageously the two non-metal half shells are respectively formed from a plastic. Plastic sides can easily be produced e.g. in an injection molding process at low cost and at a high repetition rate. Moreover, the use of plastic also reduces the weight of the dispenser. The plastic may be a fiber reinforced plastic in order to improve the stability of the two non-metal half shells.

Preferably the reinforcing plate is composed from a material selected from either fiber reinforced plastics or metal, in particular aluminum.

Aluminum is a metal that can be readily machined that is comparatively light weight, durable and inexpensive and that can cope with any forces that arise at the front end of the housing.

Using a fiber reinforced metal plate can further reduce the weight of the housing and also increase the stability of the front end of the housing.

In a further aspect the present invention relates to a dispenser, in particular a one or two-component, preferably hand-held dispenser, having a housing in accordance with the description provided herein.

The advantages described in connection with the housing likewise hold true for the dispenser in accordance with the invention.

In this connection it is advantageous if the dispenser further comprises at least one plunger for each component to be dispensed and an actuation mechanism moving the at least one plunger in a dispensing direction, with the actuation mechanism being activated by a trigger, for example formed as a trigger lever.

In a further aspect the present invention relates to a use of the dispenser as described herein for the dispensing of sealing agents, adhesives, dental materials, and materials used in the construction field.

BRIEF DESCRIPTION OF THE DRAWINGS

The invention will be explained in more detail hereinafter with reference to the drawings.

DETAILED DESCRIPTION OF THE EMBODIMENTS

Figure 1:
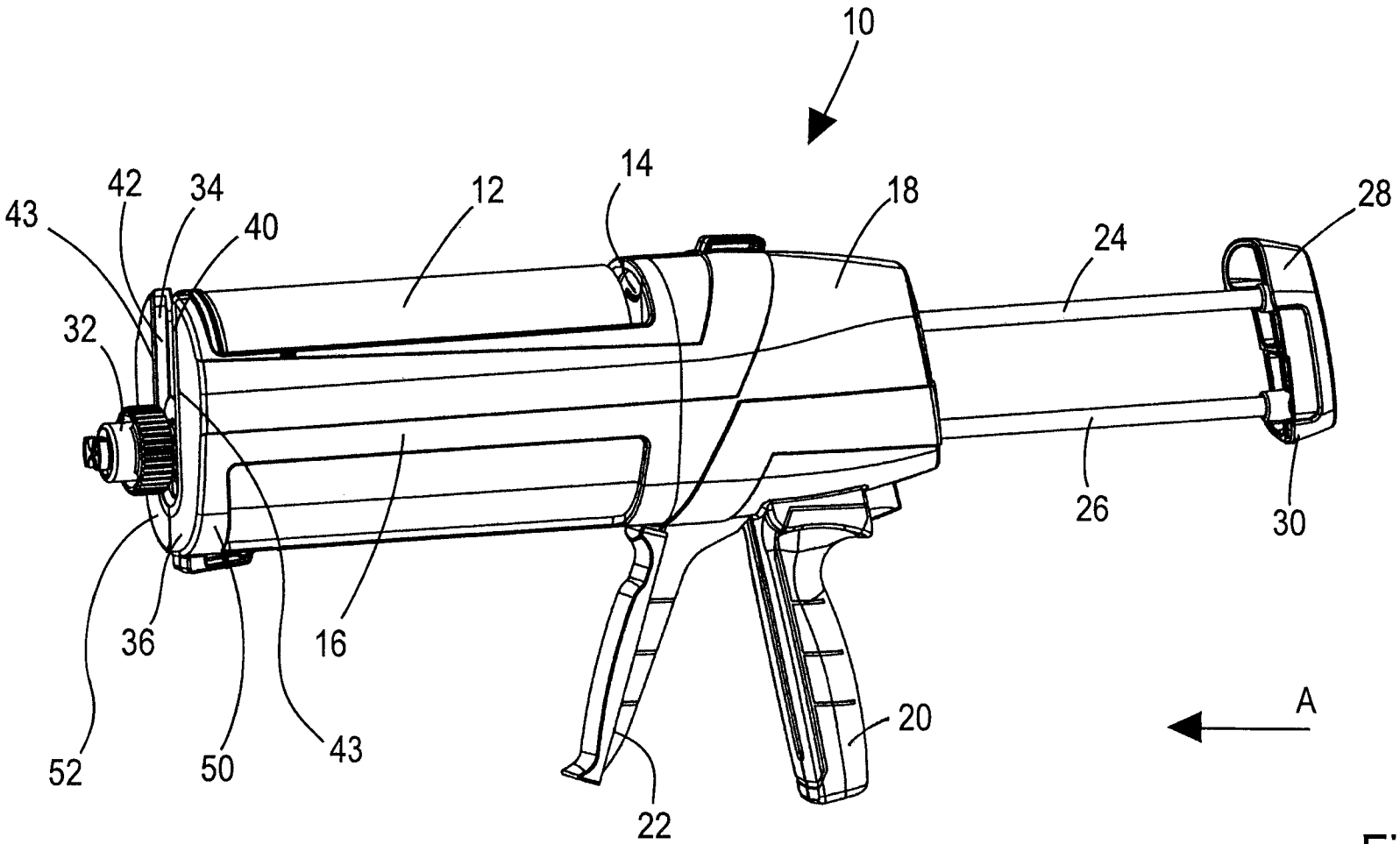
FIG. 1 is a perspective view of a two-component dispenser.

In the following the same reference numerals will be used for parts having the same or equivalent function. Any statements made having regard to the direction of a component are made relative to the position shown in the drawing and can naturally vary in the actual position of application.

FIG. 1 shows a two-component dispenser 10 having a cartridge 12 installed in a receptacle 14 present in the front part 16 of a housing 18 of the two-component dispenser 10. A handle 20 is attached to the housing 18 so that a user (not shown) of the two-component dispenser 10 can hold the two-component dispenser 10.

In order to dispense substances from the cartridge 12 the user can activate a trigger lever 22 in order to effect a movement of two push rods 24, 26 in a dispensing direction A. The two push rods 24, 26 are held by a rod handle 28 at the rear end 30 of the two-component dispenser 10.

In use of the cartridge 12 a mixing tip 32 (of which only a cut off base is shown in FIG. 1) is placed at the end of the cartridge 12. During storage of the cartridge 12 in the cartridge receptacle 14, the mixing tip 32 can be replaced by an end cap (not shown). The mixing tip 32 or end cap is arranged adjacent to an opening 42 formed in a reinforcing plate 34 arranged at the front end 36 of the front part 16 of the housing 18.

The housing 18 shown in FIG. 1 comprises two half shells 50, 52 that once connected to one another form the cartridge receptacle 14 in the front part 16 of the housing 18. These two half shells 50, 52 each have an opening 43 present therein at the front end 36, with the openings 43 receiving a part of the reinforcing plate 34. At the top end of the half shells 50, 52 these are not connected to one another, i.e. they remain open. The openings 42 and 43 are respectively provided so that the cartridge 12 front end can be received at the front end 36 of the housing 18.

The reinforcing plate 34 is designed such that it in use forms a point of connection at the front end 36 of the housing 18 between the two half shells 50, 52, without having to provide material that directly connects the two half shells 50, 52 at their top end. The reinforcing plate 34 is provided such that it prevents the two half shells 50, 52 from being pushed apart on an application of pressure on dispensing components from the cartridge 12. This pressure is exerted on the cartridge 12 via the push rods 24, 26 and is transmitted to the region of the outlet of the cartridge 12 via the cartridge 12 and hence to the reinforcing plate 34.

Figure 2:
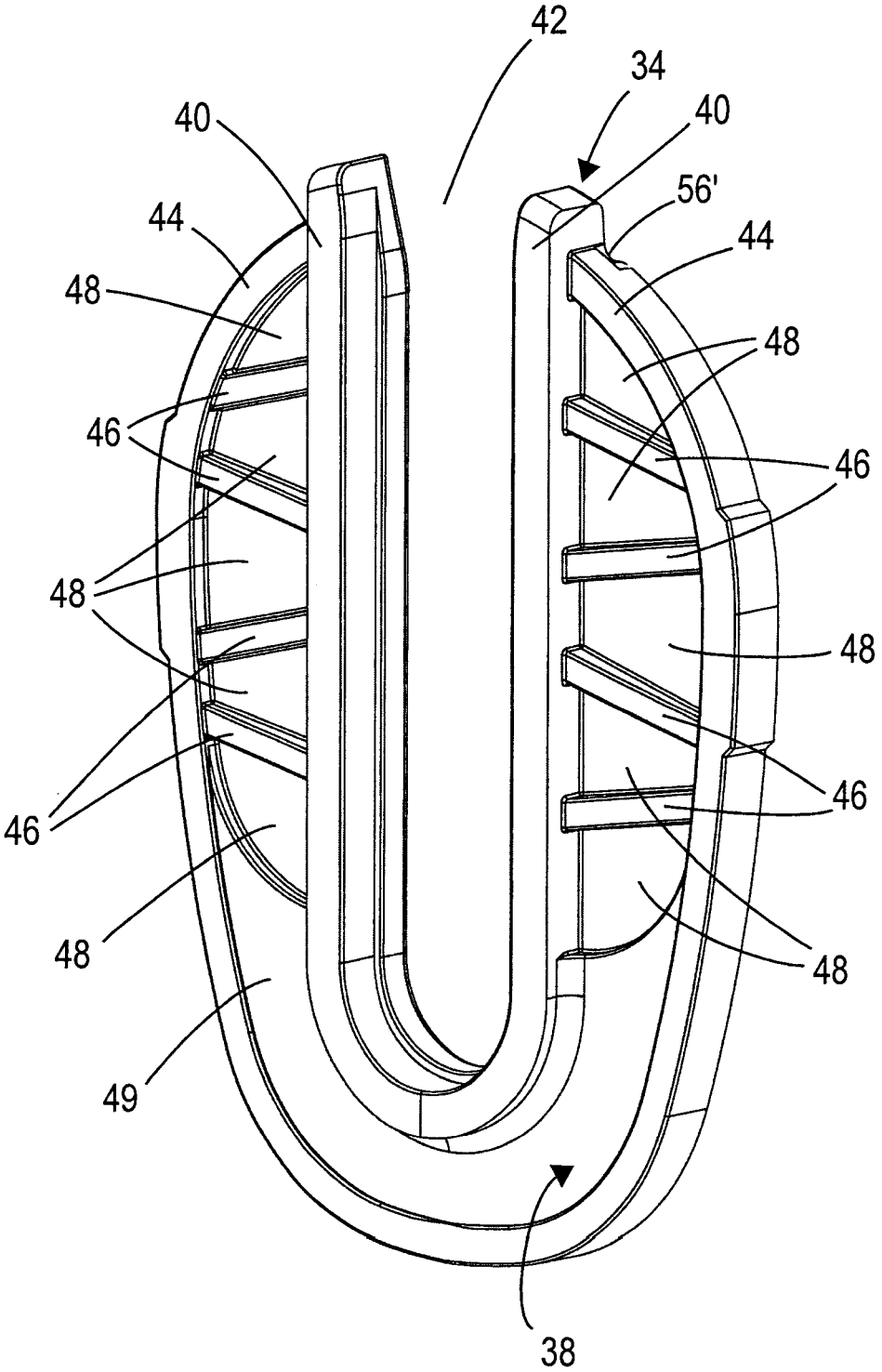
FIG. 2 is a perspective view of a reinforcing plate.

FIG. 2 shows a perspective view of a first type of reinforcing plate 34. As is clear, the front side 38 of this reinforcing plate 34 is not flat. It has a reinforced inner rim 40 surrounding the opening 42. The reinforced inner rim 40 is provided to impart stability to the reinforcing plate 34 and to the housing 18 at the front end 36. This increased stability is provided in order to aid in counteracting any forces transmitted to the front end 36 during a dispensing mode of operation of the dispenser 10.

The opening 42 is provided for the reception of an outlet (not shown) present at the front end of a cartridge 12.

The mixing tip 32 or end cap are typically connected to the outlet of the cartridge 12. For this reason provision could be made such that the mixing tip 32 or end cap could also be received in the opening (not shown).

The reinforcing plate 34 further has a peripherally extending outer rim 44 extending along the outside of the reinforcing plate 34. This outer rim 44 acts as a retainer (retaining means or device) in use, as it can engage a respective groove 62 (see FIGS. 3 and 4) disposed in each half shell 50, 52 and thereby prevent the two half shells 50, 52 from being pushed apart in the dispensing mode of operation, as the outer rim 44 retains the position of the respective half shell 50, 52. Thereby the grooves 62, or more precisely the side walls of the grooves 62 act as a holder (holding means or device), i.e. as counterparts to the retainer.

The reinforcing plate 34 further comprises a peripherally extending groove 49 that is designed to accommodate material from the front end 36 of the housing 18. The peripherally extending groove 49 is formed between the inner rim 40 and the outer rim 44. In this connection it should be noted that a height of the inner rim 40 is larger than a height of the outer rim 44. One of the reasons for this is that the inner rim 40 also forms part of the outer surface of the front end 16 as can be seen e.g. in FIGS. 1 and 4. From these FIGS. it can be seen that the inner rim 40 is visible from the outside, thus forming part of the outer surface of the front end 16, while the remaining parts of the reinforcing plate 34 are not visible from the outside since they are covered by the front end 36 of the housing 18. The outer surface of the inner rim 40 forms a boundary of the opening 42 and is, in the shown embodiment, flush with the adjacent outer surface of the front end 36 of the housing 18 Another reason is to impart stability to the reinforcing plate 34 in the region of the opening 42.

Part of the groove 49 comprises further a further retainer (retaining means or device) present in the form of ribs 46 that respectively extend between the reinforced inner rim 40 and the peripherally extending outer rim 44. A front view of the ribs 46 shows that these are arranged to form a shape that corresponds to a "W" on either side of the reinforced inner rim 40. In order to obtain this "W" shape recesses or spaces 48 are respectively formed between the reinforced inner rim 40, the peripherally extending outer rim 44 and the ribs 46 in the groove 49 in the upper part of the reinforced plate 34. The spaces 48 can accommodate material from the front end 36 of the housing 18 (see FIG. 3 in this regard) acting as a further holder (holding means or device) in connection with the obliquely running ribs 46.

It should be noted that the reinforcing plate 34 does not necessarily have to include the ribs 46 and spaces 48, but could merely include one groove 49 that either has a constant depth or a varying depth, e.g. the groove could have two or more regions of constant depth, with the respective depth differing from one another.

The respective half shell 50, 52 would then only have one projection of varying height or two or more projections each with differing height etc.

It should further be noted in this connection that the ribs 46 and the spaces 48 can be formed in the part of the groove 49 of FIG. 2 that presently does not contain any ribs or spaces.

Figure 3:
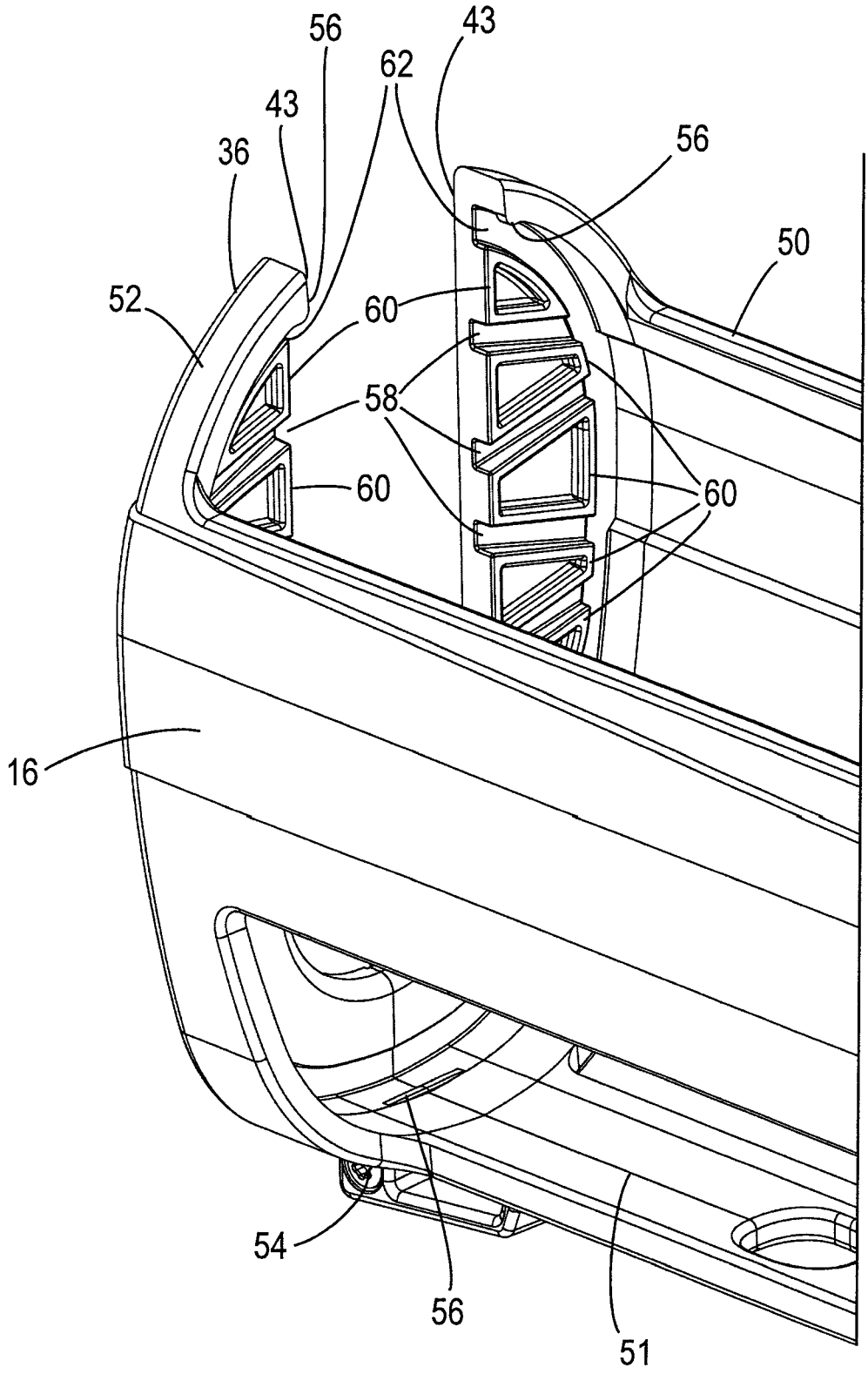
FIG. 3 is a perspective view of a front end of a housing of the dispenser without a rein forcing plate installed.

FIG. 3 shows a perspective view of the front end 36 of the housing 18 of the dispenser 10 without a reinforcing plate 34 installed therein. The housing is composed of two half shells 50, 52 that are connected one to another via the reinforcing plate 34, when this is installed, and via screwed connections 54. The screwed connections 54 are provided at specific further points of which only one is shown in this drawing. The two half shells 50, 52 are connected one to another at a connection line 51.

The inner surface of the front end 36 shows a series of recesses 58 and projections 60 that are formed therein. The interaction of the ribs 46 and spaces 48 of the reinforcing plate 34 with the recesses 58 and projections 60 can be seen in FIG. 4, the ribs 46 thereby acting a retainer(s) and the projections 60 as a holder(s).

The inner surface of the front end 36 further comprises a respective groove 62 formed in each of the half shells 50, 52. These grooves 62 are configured to interact with the peripherally extending outer rim 44 of the reinforcing plate 34 of FIG. 2. This can be seen at the top end of FIG. 4.

Figure 4:
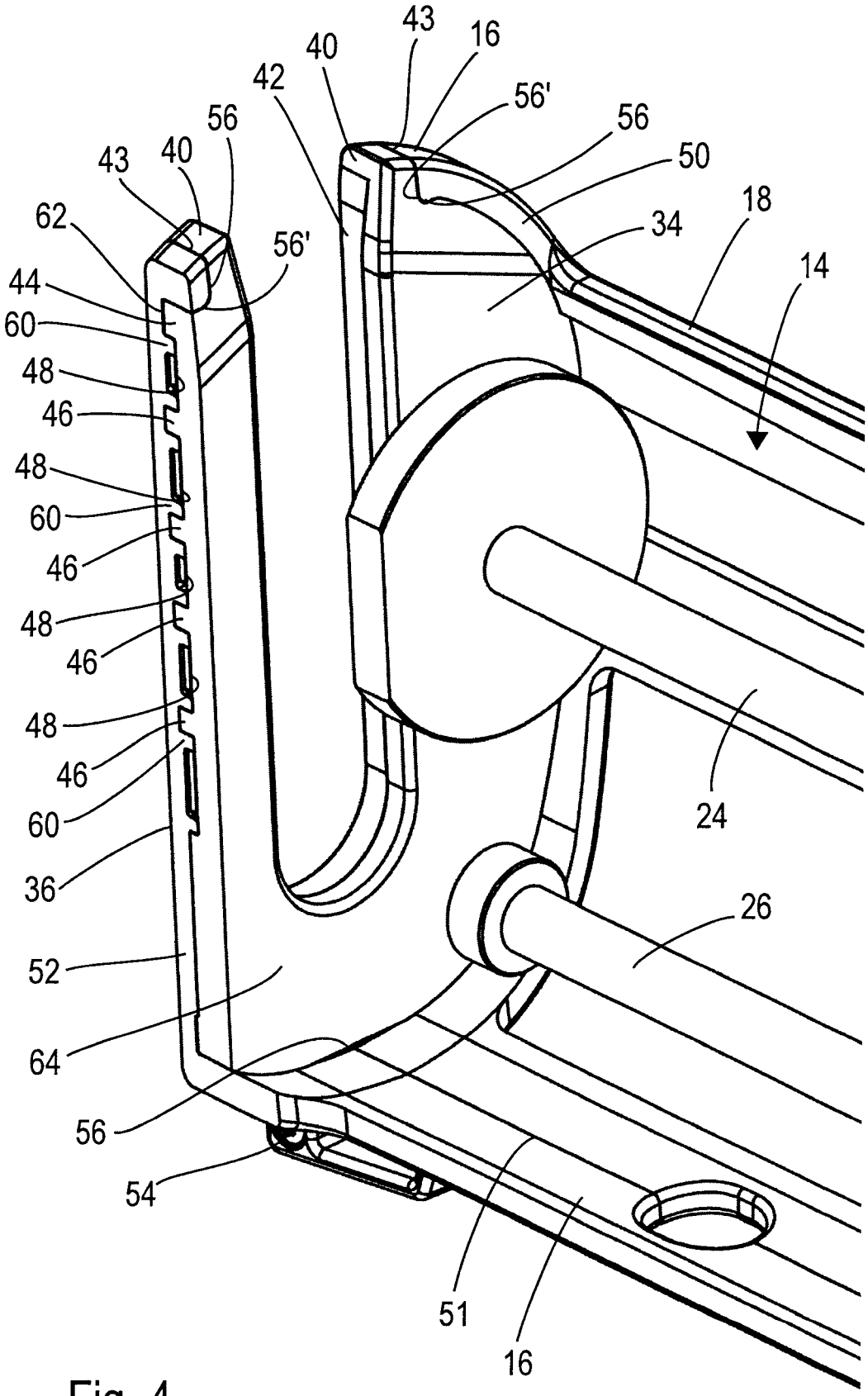
FIG. 4 is a perspective part sectional view of the housing of FIG. 3 with the reinforcing plate of FIG. 2 installed therein.

FIG. 3 also shows snap-in members 56 that are disposed on the inner surface of the two half shells 50, 52 and that are used to further stabilize the connection between the two half shells 50, 52 and the reinforcing plate 34 by snapping the reinforcing plate 34 into place on an installation of the reinforcing plate 34 at the front end 36 of the housing 18 (see FIG. 4 for a reinforcing plate 34 that is installed between two half shells 50, 52). The snap-in members 56 are embodied as small protrusions or ribs and can cooperate with corresponding counterparts embodied e.g. as small grooves 56' (see FIGS. 2 and 4) in the reinforcing plate 34 or with an outer edge 66 (see FIG. 5) of the reinforcement plate 34.

It should be noted in this connection that only one snap-in member 56 could be provided, this could then be designed as e.g. a small bulge that extends adjacent to at least part of the side of the reinforcing plate 34 that is remote from the inner rim 40.

FIG. 4 shows a perspective part sectional view of the housing 18 of FIG. 3 with the reinforcing plate 34 of FIG. 2 installed therein. The cooperation between the ribs 46 and spaces 48 of the reinforcing plate 34, on the one hand, and the projections 60 and recesses 58 complementary to the ribs 46 and spaces 48 can be seen in this regard. Likewise the cooperation between the peripherally extending outer rim 44 of the reinforcing plate 34 and the groove 62 of the respective half shell 52 can be seen in FIG. 4.

As can further be seen from FIG. 4, the reinforcing plate 34 covers at least 90% of an inner surface 64 of the front end 36 of the housing 18. Moreover, the complete opening 42 present between the inner rim 40 of the reinforcing plate 34 that receives an outlet from the cartridge 12 is reinforced by the reinforcing plate 34. This opening 42 is open to one side of the dispenser 10, namely the side from which a cartridge 12 can be inserted into the cartridge receptacle 14.

Figure 5:
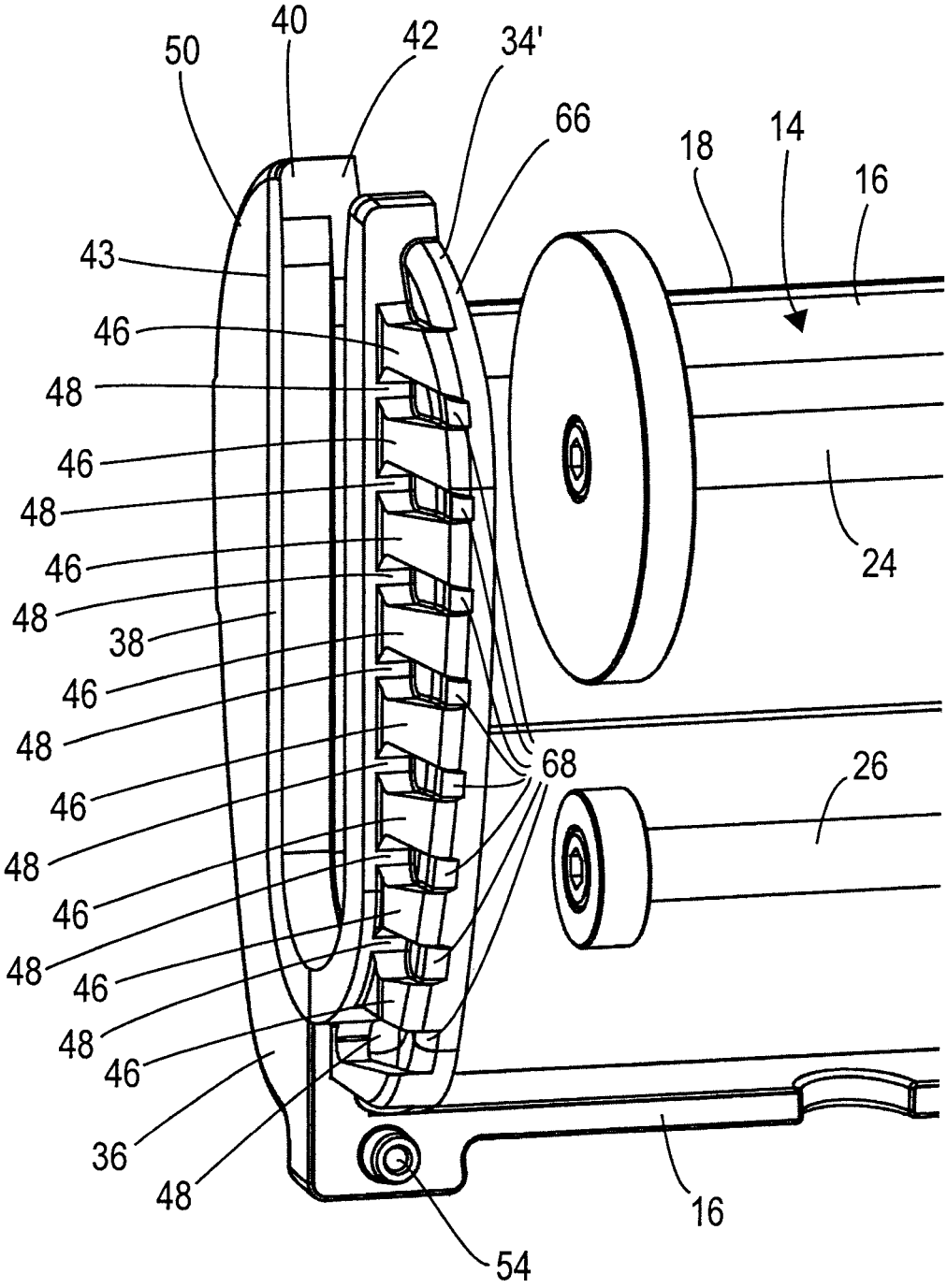
FIG. 5 is a perspective view of part of a housing with a second kind of reinforcing plate installed therein.

FIG. 5 shows a perspective view of part of the housing 18 with a second kind of reinforcing plate 34' installed therein. The reinforcing plate 34' comprises ribs 46 that have a varying width and height over their length.

It should be noted that no continuous groove 49 is disposed in the reinforcing plate 34', but rather this only comprises a plurality of ribs 46 and spaces 48.

When inspecting the diameter of the ribs 46 as they extend from the inner rim 40 towards the outer edge 66 in FIG. 5, they initially taper inwardly and then taper outwardly again towards their end at which is opposite to the end connected to the inner rim 40. In this way the ribs 46 have a shape that looks like two inverted truncated cones that are connected one to another in a front view of the reinforcing plate 34'.

Moreover, the ribs 46 extend from the inner rim 40 to the outer edge 66 of the reinforcing plate 34' in such a way that the ribs also partly form part of the outer edge 66. The surface 48 formed between the inner rim 40, the ribs 46 and the outer edge 66 is terminated at a peripheral outer rim 68. In this example of the reinforcing plate 34' the outer rim 68 is not a continuous outer rim, as is the case having regard to the outer rim 44 of the reinforcing plate shown in connection with FIGS. 1 to 4.

As can also be seen in FIG. 5, the height of the ribs 46 decreases from the inner rim 40 to the outer edge 66.

It should be noted in connection with FIG. 5, that ribs of varying width and height are shown, that are not arranged in a groove. However, designs are covered by the present disclosure in which ribs of uniform shape could be disposed in a reinforcing plate.

In use the reinforcing plates 34, 34, 34' shown herein are designed to reinforce the front end 36 of the housing 18 of the dispenser 10. To this end the reinforcing plates 34, 34, 34' each have structures formed at at least one side thereof that permit an anchorage of the two half shells 50, 52 to the reinforcing plates 34, 34, 34'. This anchorage, on the one hand, permits a connection between the reinforcing plates 34, 34, 34' and the two half shells 50, 52 and, on the other hand, also prevents the two half shells 50, 52 from being spread apart when forces are transmitted to the front end 36 via the cartridge 12 installed in the dispenser 10 during a dispensing mode of operation of the dispenser 10.

While the described embodiments show the retainer and the holder comprising specific structures like grooves, recesses, projections and rims it may be noted that these structures can be exchanged as long as an engagement of these structures with its corresponding counterparts prevents a spreading apart of the two sides of the front end of the housing formed by the two non-metal half shells.

The invention claimed is:

1. A housing for a dispenser, the housing comprising:

two non-metal half shells forming respective sides of at least a front part of the housing, the front part of the housing comprising a cartridge receptacle, and the two non-metal half shells being connected to one another; and a reinforcing plate forming at least part of a front end of the cartridge receptacle, the reinforcing plate being received between the two non-metal half shells and comprising a retainer configured to connect the two non-metal half shells at the front end of the cartridge receptacle, at least one of the two non-metal half shells further comprising a snap-in member, the snap-in member being configured to engage the reinforcing plate, the snap-in member disposed on an inner surface of the at least one of the two half shells and formed by one of a small protrusion and a rib and cooperating with a corresponding counter part in the reinforcing plate.

2. The housing in accordance with claim 1, wherein the reinforcing plate comprises an opening extending from a rear side to a front side of the reinforcement plate.

3. The housing in accordance with claim 2, wherein the opening is open at a narrow side of the reinforcing plate.

4. The housing in accordance with claim 3, wherein the opening is a U-shaped slot, a V-shaped slot or a rectangular-shaped slot.

5. The housing in accordance with claim 1, wherein the two non-metal half shells respectively comprise a holder at the front end of the cartridge receptacle that cooperates with the retainer formed in or at the reinforcing plate and with the holder being formed at a respective inner surface of the two non-metal half shells at a front end thereof.

6. The housing in accordance with claim 5, wherein the holder engages undercuts present in the retainer.

7. The housing in accordance with claim 1, wherein the retainer comprises retaining ribs that cooperate with projections or recesses formed in each of the two non-metal half shells.

8. The housing in accordance with claim 1, wherein the reinforcing plate comprises at least one groove extending in a peripheral region and each non-metal half shell comprises at least one projection engaging into the at least one groove, or vice versa.

9. The housing in accordance with claim 8, wherein the at least one groove comprises at least one recess and one or each of the non-metal half shells comprises at least one further projection engaging into the at least one recess.

10. The housing in accordance with claim 8, wherein the retainer comprises a peripherally extending outer rim and each non-metal half shell comprises at least one groove, the outer rim at least partially engaging into the respective at least one groove formed in each non-metal half shell.

11. The housing in accordance with claim 1, wherein the two non-metal half shells are connected to one another either in a releasable or a non-releasable manner.

12. The housing in accordance with claim 1, wherein the reinforcing plate forms at least 70% of a surface area of an inner front end face of the cartridge receptacle.

13. The housing in accordance with claim 1, wherein the two non-metal half shells are respectively formed from a plastic.

14. The housing in accordance with claim 1, wherein the reinforcing plate is composed from a material selected from either fiber reinforced plastics or metal.

15. A dispenser for dispensing at least one component, comprising:

the housing in accordance with claim 1.

16. The dispenser in accordance with claim 15, further comprising at least one plunger for each of the at least one component to be dispensed and an actuation mechanism moving the at least one plunger in a dispensing direction, the actuation mechanism being activated by a trigger.

17. The dispenser in accordance with claim 15, wherein the dispenser is a one or two component hand-held dispenser.

18. The housing in accordance with claim 1, wherein the reinforcing plate forms approximately 90% of a surface area of an inner front end face of the cartridge receptacle.

19. The housing in accordance with claim 1, wherein the reinforcing plate is aluminum.

* * * * *